US006394652B2

(12) United States Patent
Meyer et al.

(10) Patent No.: US 6,394,652 B2
(45) **Date of Patent: *May 28, 2002**

(54) FLEXIBLE BAGS HAVING STRETCH-TO-FIT CONFORMITY TO CLOSELY ACCOMMODATE CONTENTS IN USE

(75) Inventors: Eric Walter Meyer, Wyoming; John Thomas Cooper, West Chester; Daniel Raymond Cerone, West Chester; Charles John Berg, Jr., Wyoming; Barry Jay Anderson, Cincinnati; Beverly Julian Jackson, Hamilton, all of OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/336,212

(22) Filed: Jun. 18, 1999

(51) Int. Cl.[7] ..... B65D 30/02

(52) U.S. Cl. ..... 383/118; 383/903; 383/6; 383/37; 383/42; 206/390

(58) Field of Search ..... 383/37, 118, 6, 383/42, 903; 206/390; 229/920, 928

(56) References Cited

U.S. PATENT DOCUMENTS

| | | | | |
|---|---|---|---|---|
| 584,555 | A | | 6/1897 | Lorenz |
| 605,343 | A | | 6/1898 | Ross |
| 1,853,374 | A | | 4/1932 | Oxhandler |
| 1,962,071 | A | * | 6/1934 | Greene |
| 2,653,751 | A | * | 9/1953 | Vogt ..... 383/37 |
| 3,186,626 | A | * | 6/1965 | Shvetz ..... 383/37 |
| 3,217,971 | A | * | 11/1965 | Shvetz ..... 383/37 X |
| 3,224,574 | A | | 12/1965 | McConnell et al. |
| 3,254,828 | A | * | 6/1966 | Lerner ..... 383/37 |
| 3,367,380 | A | | 2/1968 | Dickey |
| 3,411,698 | A | | 11/1968 | Reynolds |
| 3,462,067 | A | | 8/1969 | Shore |
| 3,549,381 | A | | 12/1970 | Kinsinger |
| 3,575,781 | A | | 4/1971 | Pezely |
| 3,682,372 | A | | 8/1972 | Rodley |
| 3,738,565 | A | | 6/1973 | Ackley et al. |

(List continued on next page.)

FOREIGN PATENT DOCUMENTS

| | | |
|---|---|---|
| DE | 703818 | 3/1941 |
| DE | 2444742 A1 | 4/1976 |
| DE | 2437968 C3 | 12/1979 |
| EP | 0 338 747 A1 | 10/1989 |
| FR | 991671 | 10/1951 |
| FR | 2056951 | 5/1971 |
| FR | 2576834 A1 | 8/1986 |
| GB | 1302940 | 1/1973 |
| GB | 2175564 A | 12/1986 |
| JP | 4065223 B2 | 5/1999 |
| NL | 6918650 | 6/1971 |
| WO | WO 92/20593 | 11/1992 |
| WO | WO 95/00405 A1 | 1/1995 |
| WO | WO 96/06733 A1 | 3/1996 |
| WO | WO 97/29966 A1 | 8/1997 |

*Primary Examiner*—Lee Young
*Assistant Examiner*—Robin A. Hylton
(74) *Attorney, Agent, or Firm*—William S. Andes; Stephen T. Murphy; David K. Mattheis

(57) ABSTRACT

The present invention provides a flexible bag comprising at least one sheet of flexible sheet material assembled to form a semi-enclosed container having an opening defined by a periphery. The opening defines an opening plane, and bag is expandable in response to forces exerted by contents within the bag to provide an increase in volume of the bag such that said the accommodates the contents placed therein.

18 Claims, 3 Drawing Sheets

U.S. PATENT DOCUMENTS 3,904,465 A 9/1975 Haase et al.
3,970,241 A 7/1976 Hanson
3,973,063 A 8/1976 Clayton
4,555,605 A 11/1985 Brown et al.
4,567,984 A 2/1986 Gietman, Jr.
4,571,337 A 2/1986 Cage et al.
4,583,642 A * 4/1986 Blythe et al. ..... 206/390 X
4,597,494 A * 7/1986 Benoit ..... 206/390
4,612,431 A 9/1986 Brown et al.
4,661,671 A 4/1987 Maroszek
4,736,450 A 4/1988 Van Erden et al.
4,739,884 A 4/1988 Duplessy
4,742,203 A 5/1988 Brown et al.
4,781,301 A * 11/1988 Le Bret et al. ..... 220/672
4,808,421 A 2/1989 Mendenhall et al.
4,848,930 A 7/1989 Williams et al.
4,849,090 A * 7/1989 Case et al. ..... 209/390
4,850,508 A * 7/1989 Lee ..... 206/390
4,890,736 A * 1/1990 Greyvenstein ..... 206/390
4,898,477 A 2/1990 Cox et al.
4,904,092 A * 2/1990 Campbell et al. ..... 20/390 X
4,930,644 A 6/1990 Robbins, III
4,938,608 A * 7/1990 Espinosa ..... 383/37 X
5,044,774 A 9/1991 Bullard et al.
5,061,500 A 10/1991 Mendenhall
5,140,119 A 8/1992 Brown et al.
5,167,377 A * 12/1992 Chalmers
5,186,988 A * 2/1993 Dixon ..... 206/390 X
5,195,829 A 3/1993 Watkins et al.
5,205,650 A 4/1993 Rasmussen
5,246,110 A 9/1993 Greyvenstein
5,290,104 A * 3/1994 Sengewald ..... 383/37 X
5,314,252 A 5/1994 Happ
5,364,189 A 11/1994 Kuge et al.
5,507,579 A 4/1996 Sorenson
5,518,801 A 5/1996 Chappell et al.
5,524,990 A 6/1996 Buck
5,547,284 A 8/1996 Imer
5,554,093 A 9/1996 Porchia et al.
5,575,747 A 11/1996 Dais et al.
5,605,594 A 2/1997 May
5,618,111 A 4/1997 Porchia et al.
5,650,214 A 7/1997 Anderson et al.
5,699,932 A * 12/1997 Claydon et al. ..... 220/671
5,730,312 A * 3/1998 Hung ..... 206/390 X
5,743,458 A * 4/1998 French ..... 383/118 X
5,743,460 A 4/1998 Capy et al.
5,921,390 A * 7/1999 Simhaee ..... 383/37 X
5,950,818 A * 9/1999 Paulsen
6,113,269 A * 9/2000 DeMatteis et al.
6,150,647 A * 11/2000 Anderson et al.

* cited by examiner

FLEXIBLE BAGS HAVING STRETCH-TO-FIT CONFORMITY TO CLOSELY ACCOMMODATE CONTENTS IN USE

FIELD OF THE INVENTION

The present invention relates to flexible bags of the type commonly utilized for the containment and/or disposal of various items and/or materials.

BACKGROUND OF THE INVENTION

Flexible bags, particularly those made of comparatively inexpensive polymeric materials, have been widely employed for the containment and/or disposal of various items and/or materials.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible bags of the type commonly available are typically formed from materials having consistent physical properties throughout the bag structure, such as stretch, tensile, and/or elongation properties.

With such flexible bags, it is frequently difficult to provide bags which precisely accommodate the dimensions and volume of the contents to be placed therein. Excess interior space may lead to degradation of the contents due to trapped air space, not to mention wasted bag material due to unused volume. In addition, for such uses as colostomy bags, it is desirable to maximize discretion by minimizing the size of the bag to the volume and dimensions necessary to accommodate the contents. The packaging of bags prior to use is also constrained by the dimensions of the bag as-provided.

Accordingly, it would be desirable to provide a flexible bag which is capable of closely conforming to the volume and/or dimensions of the bag contents in use.

SUMMARY OF THE INVENTION

The present invention provides a flexible bag comprising at least one sheet of flexible sheet material assembled to form a semi-enclosed container having an opening defined by a periphery. The opening defines an opening plane, and bag is expandable in response to forces exerted by contents within the bag to provide an increase in volume of the bag such that said the accommodates the contents placed therein.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
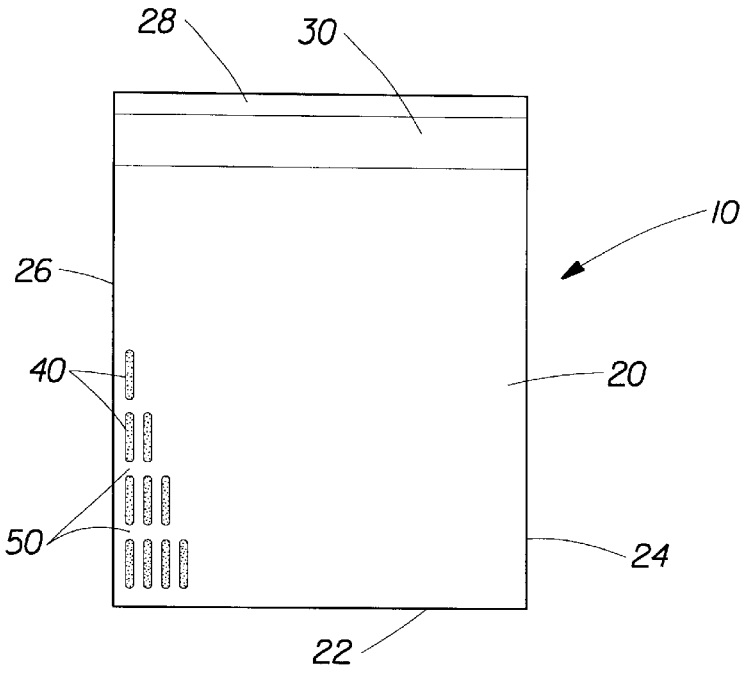
FIG. 1 is a plan view of a flexible bag in accordance with the present invention in a closed, empty condition.

Flexible Bag Construction:

FIG. 1 depicts a presently preferred embodiment of a flexible bag 10 according to the present invention. In the embodiment depicted in FIG. 1, the flexible bag 10 includes a bag body 20 formed from a piece of flexible sheet material folded upon itself along fold line 22 and bonded to itself along side seams 24 and 26 to form a semi-enclosed container having an opening along edge 28. Flexible storage bag 10 also optionally includes closure means 30 located adjacent to edge 28 for sealing edge 28 to form a fully-enclosed container or vessel as shown in FIG. 1. Bags such as the flexible bag 10 of FIG. 1 can be also constructed from a continuous tube of sheet material, thereby eliminating side seams 24 and 26 and substituting a bottom seam for fold line 22. Flexible storage bag 10 is suitable for containing and protecting a wide variety of materials and/or objects contained within the bag body.

In the preferred configuration depicted in FIG. 1, the closure means 30 completely encircles the periphery of the opening formed by edge 28. However, under some circumstances a closure means formed by a lesser degree of encirclement (such as, for example, a closure means disposed along only one side of edge 28) may provide adequate closure integrity.

FIG. 1 shows a plurality of regions extending across the bag surface. Regions 40 comprise rows of deeply-embossed deformations in the flexible sheet material of the bag body 20, while regions 50 comprise intervening undeformed regions. As shown in FIG. 1, the undeformed regions have axes which extend across the material of the bag body in a direction substantially parallel to the plane (axis when in a closed condition) of the open edge 28, which in the configuration shown is also substantially parallel to the plane or axis defined by the bottom edge 22.

In accordance with the present invention, the body portion 20 of the flexible storage bag 10 comprises a flexible sheet material having the ability to elastically elongate to accommodate the forces exerted outwardly by the contents introduced into the bag in combination with the ability to impart additional resistance to elongation before the tensile limits of the material are reached. This combination of properties permits the bag to readily initially expand in response to outward forces exerted by the bag contents by controlled elongation in respective directions. These elongation properties increase the internal volume of the bag by expanding the length of the bag material.

Additionally, while it is presently preferred to construct substantially the entire bag body from a sheet material having the structure and characteristics of the present invention, it may be desirable under certain circumstances to provide such materials in only one or more portions or zones of the bag body rather than its entirety. For example, a band of such material having the desired stretch orientation could be provided forming a complete circular band around the bag body to provide a more localized stretch property.

Figure 2:
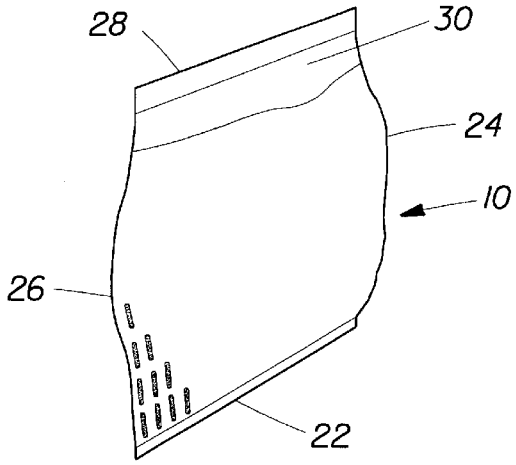
FIG. 2 is a perspective view of the flexible bag of FIG. 1 in a closed condition with material contained therein.
Figure 3:
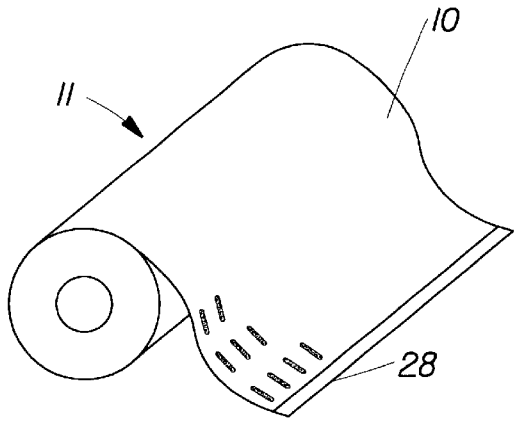
FIG. 3 is a perspective view of a continuous roll of bags such as the flexible bag of FIG. 1.

FIG. 2 depicts a flexible bag such as the bag 10 of FIG. 1 utilized to form a fully-enclosed product containing bag secured with a closure of any suitable conventional design. Product application areas for such bags include trash bags, body bags for containment of human or animal remains, Christmas tree disposal bags, colostomy bags, dry cleaning and/or laundry bags, bags for collecting items picked from warehouse inventory (stock pick bags), shopping bags, etc. In the limiting sense, the sheet material may have sufficient stretch or elongation properties to form a deeply drawn bag of suitable size from an initially flat sheet of material rather than forming a bag by folding and sealing operations. FIG. 3 illustrates a roll 11 of bags 10 joined in end to end fashion to form a continuous web. Since the bags in their pre-use condition may be externally smaller than typical bags of lesser stretch capability, the roll dimension may be smaller (i.e., a shorter tube may be used as a core) since the bags will expand in use to the desired size. Such roll dimensions may be particularly useful for dry cleaning bags, in either cored or coreless configurations.

Materials suitable for use in the present invention, as described hereafter, are believed to provide additional benefits in terms of reduced contact area with a trash can or other container, aiding in the removal of the bag after placing contents therein. The three-dimensional nature of the sheet material coupled with its elongation properties also provides enhanced tear and puncture resistance and enhanced visual, aural, and tactile impression. The elongation properties also permit bags to have a greater capacity per unit of material used, improving the "mileage" of such bags. Hence, smaller bags than those of conventional construction may be utilized for a given application. Bags may also be of any shape and configuration desired, including bags having handles or specific cut-out geometries.

Figure 4A:
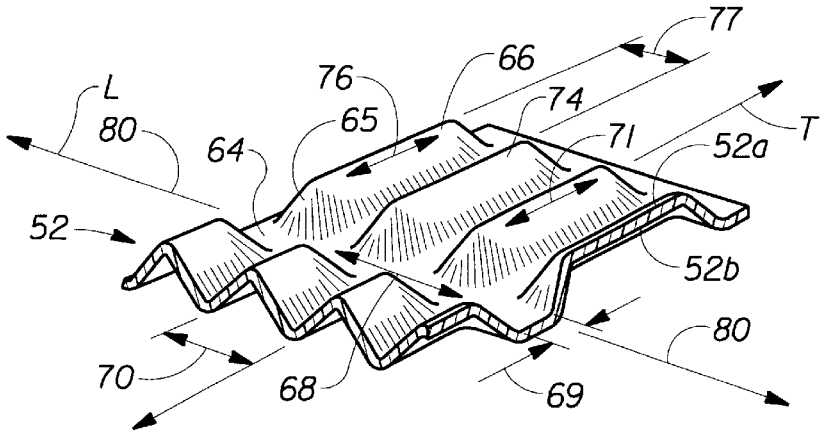
FIG. 4A is a segmented, perspective illustration of the polymeric film material of flexible bags of the present invention in a substantially untensioned condition.

Representative Materials:

To better illustrate the structural features and performance advantages of flexible bags according to the present invention, FIG. 4A provides a greatly-enlarged partial perspective view of a segment of sheet material 52 suitable for forming the bag body 20 as depicted in FIGS. 1–2. Materials such as those illustrated and described herein as suitable for use in accordance with the present invention, as well as methods for making and characterizing same, are described in greater detail in commonly-assigned U.S. Pat. No. 5,518,801, issued to Chappell, et al. on May 21, 1996, the disclosure of which is hereby incorporated herein by reference.

Referring now to FIG. 4A, sheet material 52 includes a "strainable network" of distinct regions. As used herein, the term "strainable network" refers to an interconnected and interrelated group of regions which are able to be extended to some useful degree in a predetermined direction providing the sheet material with an elastic-like behavior in response to an applied and subsequently released elongation. The strainable network includes at least a first region 64 and a second region 66. Sheet material 52 includes a transitional region 65 which is at the interface between the first region 64 and the second region 66. The transitional region 65 will exhibit complex combinations of the behavior of both the first region and the second region. It is recognized that every embodiment of such sheet materials suitable for use in accordance with the present invention will have a transitional region; however, such materials are defined by the behavior of the sheet material in the first region 64 and the second region 66. Therefore, the ensuing description will be concerned with the behavior of the sheet material in the first regions and the second regions only since it is not dependent upon the complex behavior of the sheet material in the transitional regions 65.

Sheet material 52 has a first surface 52*a* and an opposing second surface 52*b*. In the preferred embodiment shown in FIG. 4A, the strainable network includes a plurality of first regions 64 and a plurality of second regions 66. The first regions 64 have a first axis 68 and a second axis 69, wherein the first axis 68 is preferably longer than the second axis 69. The first axis 68 of the first region 64 is substantially parallel to the longitudinal axis "L" of the sheet material 52 while the second axis 69 is substantially parallel to the transverse axis "T" of the sheet material 52. Preferably, the second axis of the first region, the width of the first region, is from about 0.01 inches to about 0.5 inches, and more preferably from about 0.03 inches to about 0.25 inches. The second regions 66 have a first axis 70 and a second axis 71. The first axis 70 is substantially parallel to the longitudinal axis of the sheet material 52, while the second axis 71 is substantially parallel to the transverse axis of the sheet material 52. Preferably, the second axis of the second region, the width of the second region, is from about 0.01 inches to about 2.0 inches, and more preferably from about 0.125 inches to about 1.0 inches. In the preferred embodiment of FIG. 4A, the first regions 64 and the second regions 66 are substantially linear, extending continuously in a direction substantially parallel to the longitudinal axis of the sheet material 52.

The first region 64 has an elastic modulus E1 and a cross-sectional area A1. The second region 66 has a modulus E2 and a cross-sectional area A2.

In the illustrated embodiment, the sheet material 52 has been "formed" such that the sheet material 52 exhibits a resistive force along an axis, which in the case of the illustrated embodiment is substantially parallel to the longitudinal axis of the web, when subjected to an applied axial elongation in a direction substantially parallel to the longitudinal axis. As used herein, the term "formed" refers to the creation of a desired structure or geometry upon a sheet material that will substantially retain the desired structure or geometry when it is not subjected to any externally applied elongations or forces. A sheet material of the present invention is comprised of at least a first region and a second region, wherein the first region is visually distinct from the second region. As used herein, the term "visually distinct" refers to features of the sheet material which are readily discernible to the normal naked eye when the sheet material or objects embodying the sheet material are subjected to normal use. As used herein the term "surface-pathlength" refers to a measurement along the topographic surface of the region in question in a direction substantially parallel to an axis. The method for determining the surface-pathlength of the respective regions can be found in the Test Methods section of the above-referenced and above-incorporated Chappell et al. patent.

Methods for forming such sheet materials useful in the present invention include, but are not limited to, embossing by mating plates or rolls, thermoforming, high pressure hydraulic forming, or casting. While the entire portion of the web 52 has been subjected to a forming operation, the present invention may also be practiced by subjecting to formation only a portion thereof, e.g., a portion of the material comprising the bag body 20, as will be described in detail below.

In the preferred embodiment shown in FIG. 4A, the first regions 64 are substantially planar. That is, the material within the first region 64 is in substantially the same condition before and after the formation step undergone by web 52. The second regions 66 include a plurality of raised rib-like elements 74. The rib-like elements may be embossed, debossed or a combination thereof. The rib-like elements 74 have a first or major axis 76 which is substantially parallel to the transverse axis of the web 52 and a second or minor axis 77 which is substantially parallel to the longitudinal axis of the web 52. The length parallel to the first axis 76 of the rib-like elements 74 is at least equal to, and preferably longer than the length parallel to the second axis 77. Preferably, the ratio of the first axis 76 to the second axis 77 is at least about 1:1 or greater, and more preferably at least about 2:1 or greater.

The rib-like elements 74 in the second region 66 may be separated from one another by unformed areas. Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first region 64 and the second region 66 each have a "projected pathlength". As used herein the term "projected pathlength" refers to the length of a shadow of a region that would be thrown by parallel light. The projected pathlength of the first region 64 and the projected pathlength of the second region 66 are equal to one another.

The first region 64 has a surface-pathlength, L1, less than the surface-pathlength, L2, of the second region 66 as measured topographically in a direction parallel to the longitudinal axis of the web 52 while the web is in an untensioned condition. Preferably, the surface-pathlength of the second region 66 is at least about 15% greater than that of the first region 64, more preferably at least about 30% greater than that of the first region, and most preferably at least about 70% greater than that of the first region. In general, the greater the surface-pathlength of the second region, the greater will be the elongation of the web before encountering the force wall. Suitable techniques for measuring the surface-pathlength of such materials are described in the above-referenced and above-incorporated Chappell et al. patent.

Sheet material 52 exhibits a modified "Poisson lateral contraction effect" substantially less than that of an otherwise identical base web of similar material composition. The method for determining the Poisson lateral contraction effect of a material can be found in the Test Methods section of the above-referenced and above-incorporated Chappell et al. patent. Preferably, the Poisson lateral contraction effect of webs suitable for use in the present invention is less than about 0.4 when the web is subjected to about 20% elongation. Preferably, the webs exhibit a Poisson lateral contraction effect less than about 0.4 when the web is subjected to about 40, 50 or even 60% elongation. More preferably, the Poisson lateral contraction effect is less than about 0.3 when the web is subjected to 20, 40, 50 or 60% elongation. The Poisson lateral contraction effect of such webs is determined by the amount of the web material which is occupied by the first and second regions, respectively. As the area of the sheet material occupied by the first region increases the Poisson lateral contraction effect also increases. Conversely, as the area of the sheet material occupied by the second region increases the Poisson lateral contraction effect decreases. Preferably, the percent area of the sheet material occupied by the first area is from about 2% to about 90%, and more preferably from about 5% to about 50%.

Sheet materials of the prior art which have at least one layer of an elastomeric material will generally have a large Poisson lateral contraction effect, i.e., they will "neck down" as they elongate in response to an applied force. Web materials useful in accordance with the present invention can be designed to moderate if not substantially eliminate the Poisson lateral contraction effect.

For sheet material 52, the direction of applied axial elongation, D, indicated by arrows 80 in FIG. 4A, is substantially perpendicular to the first axis 76 of the rib-like elements 74. The rib-like elements 74 are able to unbend or geometrically deform in a direction substantially perpendicular to their first axis 76 to allow extension in web 52.

Figure 4B:
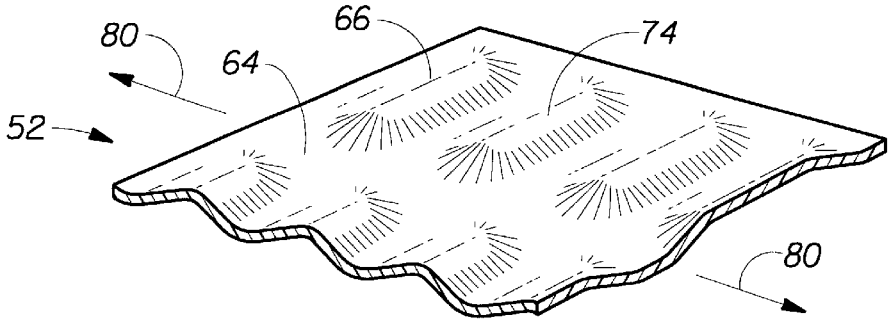
FIG. 4B is a segmented, perspective illustration of the polymeric film material of flexible bags according to the present invention in a partially-tensioned condition.

Referring now to FIG. 4B, as web of sheet material 52 is subjected to an applied axial elongation, D, indicated by arrows 80 in FIG. 4B, the first region 64 having the shorter surface-pathlength, L1, provides most of the initial resistive force, P1, as a result of molecular-level deformation, to the applied elongation. In this stage, the rib-like elements 74 in the second region 66 are experiencing geometric deformation, or unbending and offer minimal resistance to the applied elongation. In transition to the next stage, the rib-like elements 74 are becoming aligned with (i.e., coplanar with) the applied elongation. That is, the second region is exhibiting a change from geometric deformation to molecular-level deformation. This is the onset of the force wall. In the stage seen in FIG. 4C, the rib-like elements 74 in the second region 66 have become substantially aligned with (i.e., coplanar with) the plane of applied elongation (i.e. the second region has reached its limit of geometric deformation) and begin to resist further elongation via molecular-level deformation. The second region 66 now contributes, as a result of molecular-level deformation, a second resistive force, P2, to further applied elongation. The resistive forces to elongation provided by both the molecular-level deformation of the first region 64 and the molecular-level deformation of the second region 66 provide a total resistive force, PT, which is greater than the resistive force which is provided by the molecular-level deformation of the first region 64 and the geometric deformation of the second region 66.

The resistive force P1 is substantially greater than the resistive force P2 when (L1+D) is less than L2. When (L1+D) is less than L2 the first region provides the initial resistive force P1, generally satisfying the equation:

$$P1 = \frac{(A1 \times E1 \times D)}{L1}$$

When (L1+D) is greater than L2 the first and second regions provide a combined total resistive force PT to the applied elongation, D, generally satisfying the equation:

$$PT = \frac{(A1 \times E1 \times D)}{L1} + \frac{(A2 \times E2 \times |L1 + D - L2|)}{L2}$$

Figure 4C:
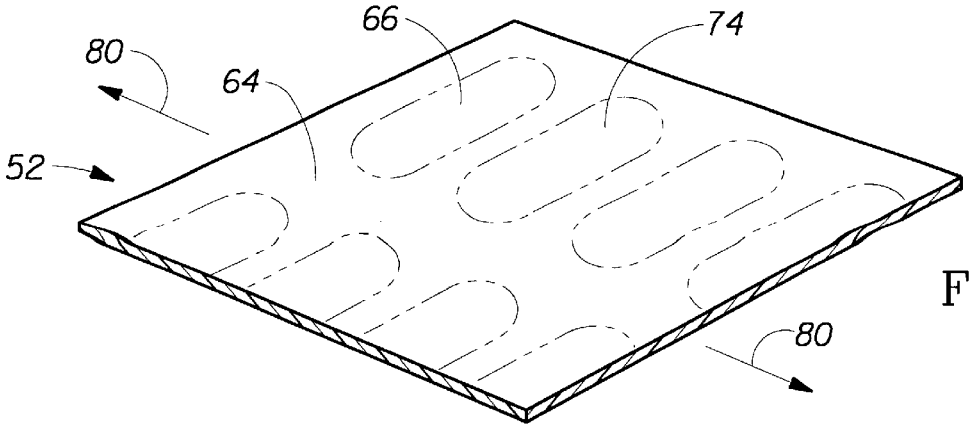
FIG. 4C is a segmented, perspective illustration of the polymeric film material of flexible bags according to the present invention in a greater-tensioned condition.

The maximum elongation occurring while in the stage corresponding to FIGS. 4A and 4B, before reaching the stage depicted in FIG. 4C, is the "available stretch" of the formed web material. The available stretch corresponds to the distance over which the second region experiences geometric deformation. The range of available stretch can be varied from about 10% to 100% or more, and can be largely controlled by the extent to which the surface-pathlength L2 in the second region exceeds the surface-pathlength L1 in the first region and the composition of the base film. The term available stretch is not intended to imply a limit to the elongation which the web of the present invention may be subjected to as there are applications where elongation beyond the available stretch is desirable.

When the sheet material is subjected to an applied elongation, the sheet material exhibits an elastic-like behavior as it extends in the direction of applied elongation and returns to its substantially untensioned condition once the applied elongation is removed, unless the sheet material is extended beyond the point of yielding. The sheet material is able to undergo multiple cycles of applied elongation without losing its ability to substantially recover. Accordingly, the web is able to return to its substantially untensioned condition once the applied elongation is removed.

While the sheet material may be easily and reversibly extended in the direction of applied axial elongation, in a direction substantially perpendicular to the first axis of the rib-like elements, the web material is not as easily extended in a direction substantially parallel to the first axis of the rib-like elements. The formation of the rib-like elements allows the rib-like elements to geometrically deform in a direction substantially perpendicular to the first or major axis of the rib-like elements, while requiring substantially molecular-level deformation to extend in a direction substantially parallel to the first axis of the rib-like elements.

The amount of applied force required to extend the web is dependent upon the composition and cross-sectional area of the sheet material and the width and spacing of the first regions, with narrower and more widely spaced first regions requiring lower applied extensional forces to achieve the desired elongation for a given composition and cross-sectional area. The first axis, (i.e., the length) of the first regions is preferably greater than the second axis, (i.e., the width) of the first regions with a preferred length to width ratio of from about 5:1 or greater.

The depth and frequency of rib-like elements can also be varied to control the available stretch of a web of sheet material suitable for use in accordance with the present invention. The available stretch is increased if for a given frequency of rib-like elements, the height or degree of formation imparted on the rib-like elements is increased. Similarly, the available stretch is increased if for a given height or degree of formation, the frequency of the rib-like elements is increased.

There are several functional properties that can be controlled through the application of such materials to flexible bags of the present invention. The functional properties are the resistive force exerted by the sheet material against an applied elongation and the available stretch of the sheet material before the force wall is encountered. The resistive force that is exerted by the sheet material against an applied elongation is a function of the material (e.g., composition, molecular structure and orientation, etc.) and cross-sectional area and the percent of the projected surface area of the sheet material that is occupied by the first region. The higher the percent area coverage of the sheet material by the first region, the higher the resistive force that the web will exert against an applied elongation for a given material composition and cross-sectional area. The percent coverage of the sheet material by the first region is determined in part, if not wholly, by the widths of the first regions and the spacing between adjacent first regions.

The available stretch of the web material is determined by the surface-pathlength of the second region. The surface-pathlength of the second region is determined at least in part by the rib-like element spacing, rib-like element frequency and depth of formation of the rib-like elements as measured perpendicular to the plane of the web material. In general, the greater the surface-pathlength of the second region the greater the available stretch of the web material.

As discussed above with regard to FIGS. 4A–4C, the sheet material 52 initially exhibits a certain resistance to elongation provided by the first region 64 while the rib-like elements 74 of the second region 66 undergo geometric motion. As the rib-like elements transition into the plane of the first regions of the material, an increased resistance to elongation is exhibited as the entire sheet material then undergoes molecular-level deformation. Accordingly, sheet materials of the type depicted in FIGS. 4A–4C and described in the above-referenced and above-incorporated Chappell et al. patent provide the performance advantages of the present invention when formed into closed containers such as the flexible bags of the present invention.

An additional benefit realized by the utilization of the aforementioned sheet materials in constructing flexible bags according to the present invention is the increase in visual and tactile appeal of such materials. Polymeric films commonly utilized to form such flexible polymeric bags are typically comparatively thin in nature and frequently have a smooth, shiny surface finish. While some manufacturers utilize a small degree of embossing or other texturing of the film surface, at least on the side facing outwardly of the finished bag, bags made of such materials still tend to exhibit a slippery and flimsy tactile impression. Thin materials coupled with substantially two-dimensional surface geometry also tend to leave the consumer with an exaggerated impression of the thinness, and perceived lack of durability, of such flexible polymeric bags.

In contrast, sheet materials useful in accordance with the present invention such as those depicted in FIGS. 4A–4C exhibit a three-dimensional cross-sectional profile wherein the sheet material is (in an un-tensioned condition) deformed out of the predominant plane of the sheet material. This provides additional surface area for gripping and dissipates the glare normally associated with substantially planar, smooth surfaces. The three-dimensional rib-like elements also provide a "cushiony" tactile impression when the bag is gripped in one's hand, also contributing to a desirable tactile impression versus conventional bag materials and providing an enhanced perception of thickness and durability. The additional texture also reduces noise associated with certain types of film materials, leading to an enhanced aural impression.

Suitable mechanical methods of forming the base material into a web of sheet material suitable for use in the present invention are well known in the art and are disclosed in the aforementioned Chappell et al. patent and commonly-assigned U.S. Pat. No. 5,650,214, issued Jul. 22, 1997 in the names of Anderson et al., the disclosures of which are hereby incorporated herein by reference.

Another method of forming the base material into a web of sheet material suitable for use in the present invention is vacuum forming. An example of a vacuum forming method is disclosed in commonly assigned U.S. Pat. No. 4,342,314, issued to Radel et al. on Aug. 3, 1982. Alternatively, the formed web of sheet material may be hydraulically formed in accordance with the teachings of commonly assigned U.S. Pat. No. 4,609,518 issued to Curro et al. on Sep. 2, 1986. The disclosures of each of the above patents are hereby incorporated herein by reference.

The method of formation can be accomplished in a static mode, where one discrete portion of a base film is deformed at a time. Alternatively, the method of formation can be accomplished using a continuous, dynamic press for intermittently contacting the moving web and forming the base material into a formed web material of the present invention. These and other suitable methods for forming the web material of the present invention are more fully described in the above-referenced and above-incorporated Chappell et al. patent. The flexible bags may be fabricated from formed sheet material or, alternatively, the flexible bags may be fabricated and then subjected to the methods for forming the sheet material.

Figure 5:
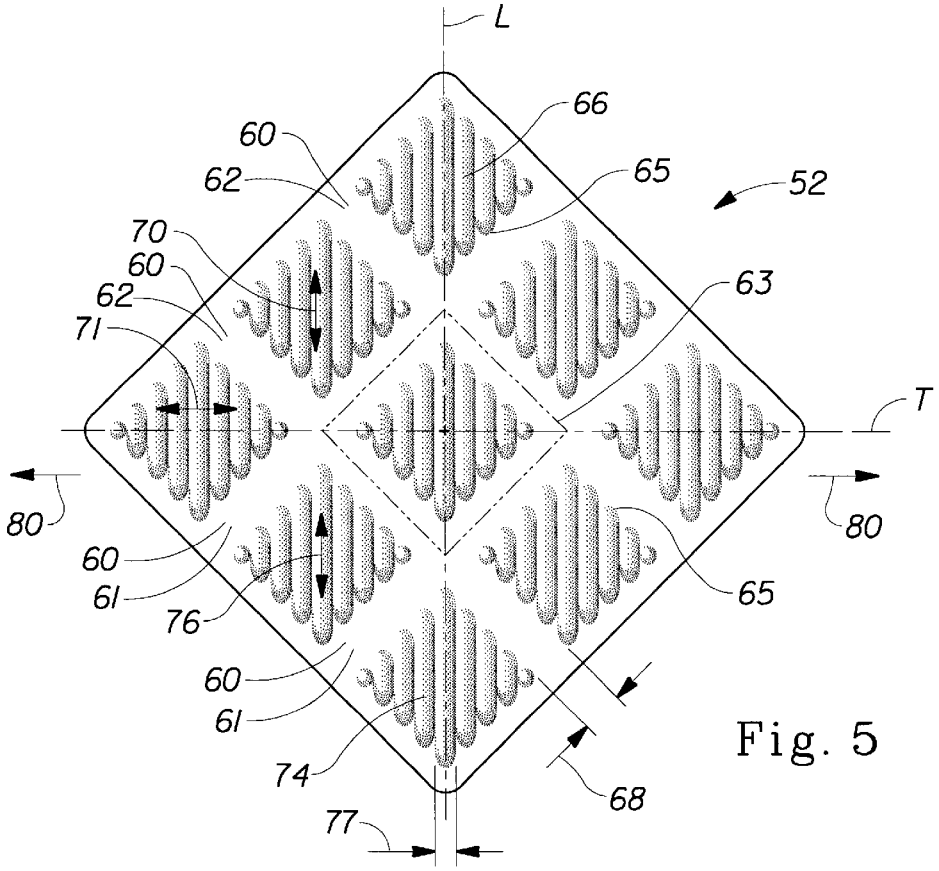
FIG. 5 is a plan view illustration of another embodiment of a sheet material useful in the present invention.

Referring now to FIG. 5, other patterns for first and second regions may also be employed as sheet materials 52 suitable for use in accordance with the present invention. The sheet material 52 is shown in FIG. 5 in its substantially untensioned condition. The sheet material 52 has two centerlines, a longitudinal centerline, which is also referred to hereinafter as an axis, line, or direction "L" and a transverse or lateral centerline, which is also referred to hereinafter as an axis, line, or direction "T". The transverse centerline "T" is generally perpendicular to the longitudinal centerline "L". Materials of the type depicted in FIG. 5 are described in greater detail in the aforementioned Anderson et al. patent.

As discussed above with regard to FIGS. 4A–4C, sheet material 52 includes a "strainable network" of distinct regions. The strainable network includes a plurality of first regions 60 and a plurality of second regions 66 which are visually distinct from one another. Sheet material 52 also includes transitional regions 65 which are located at the interface between the first regions 60 and the second regions 66. The transitional regions 65 will exhibit complex combinations of the behavior of both the first region and the second region, as discussed above.

Sheet material 52 has a first surface, (facing the viewer in FIG. 5), and an opposing second surface (not shown). In the preferred embodiment shown in FIG. 5, the strainable network includes a plurality of first regions 60 and a plurality of second regions 66. A portion of the first regions 60, indicated generally as 61, are substantially linear and extend in a first direction. The remaining first regions 60, indicated generally as 62, are substantially linear and extend in a second direction which is substantially perpendicular to the first direction. While it is preferred that the first direction be perpendicular to the second direction, other angular relationships between the first direction and the second direction may be suitable so long as the first regions 61 and 62 intersect one another. Preferably, the angles between the first and second directions ranges from about 45° to about 135°, with 90° being the most preferred. The intersection of the first regions 61 and 62 forms a boundary, indicated by phantom line 63 in FIG. 5, which completely surrounds the second regions 66.

Preferably, the width 68 of the first regions 60 is from about 0.01 inches to about 0.5 inches, and more preferably from about 0.03 inches to about 0.25 inches. However, other width dimensions for the first regions 60 may be suitable. Because the first regions 61 and 62 are perpendicular to one another and equally spaced apart, the second regions have a square shape. However, other shapes for the second region 66 are suitable and may be achieved by changing the spacing between the first regions and/or the alignment of the first regions 61 and 62 with respect to one another. The second regions 66 have a first axis 70 and a second axis 71. The first axis 70 is substantially parallel to the longitudinal axis of the web material 52, while the second axis 71 is substantially parallel to the transverse axis of the web material 52. The first regions 60 have an elastic modulus E1 and a cross-sectional area A1. The second regions 66 have an elastic modulus E2 and a cross-sectional area A2.

In the embodiment shown in FIG. 5, the first regions 60 are substantially planar. That is, the material within the first regions 60 is in substantially the same condition before and after the formation step undergone by web 52. The second regions 66 include a plurality of raised rib-like elements 74. The rib-like elements 74 may be embossed, debossed or a combination thereof. The rib-like elements 74 have a first or major axis 76 which is substantially parallel to the longitudinal axis of the web 52 and a second or minor axis 77 which is substantially parallel to the transverse axis of the web 52.

The rib-like elements 74 in the second region 66 may be separated from one another by unformed areas, essentially unembossed or debossed, or simply formed as spacing areas. Preferably, the rib-like elements 74 are adjacent one another and are separated by an unformed area of less than 0.10 inches as measured perpendicular to the major axis 76 of the rib-like elements 74, and more preferably, the rib-like elements 74 are contiguous having essentially no unformed areas between them.

The first regions 60 and the second regions 66 each have a "projected pathlength". As used herein the term "projected pathlength" refers to the length of a shadow of a region that would be thrown by parallel light. The projected pathlength of the first region 60 and the projected pathlength of the second region 66 are equal to one another.

The first region 60 has a surface-pathlength, L1, less than the surface-pathlength, L2, of the second region 66 as measured topographically in a parallel direction while the web is in an untensioned condition. Preferably, the surface-pathlength of the second region 66 is at least about 15% greater than that of the first region 60, more preferably at least about 30% greater than that of the first region, and most preferably at least about 70% greater than that of the first region. In general, the greater the surface-pathlength of the second region, the greater will be the elongation of the web before encountering the force wall.

For sheet material 52, the direction of applied axial elongation, D, indicated by arrows 80 in FIG. 5, is substantially perpendicular to the first axis 76 of the rib-like elements 74. This is due to the fact that the rib-like elements 74 are able to unbend or geometrically deform in a direction substantially perpendicular to their first axis 76 to allow extension in web 52.

Figure 6:
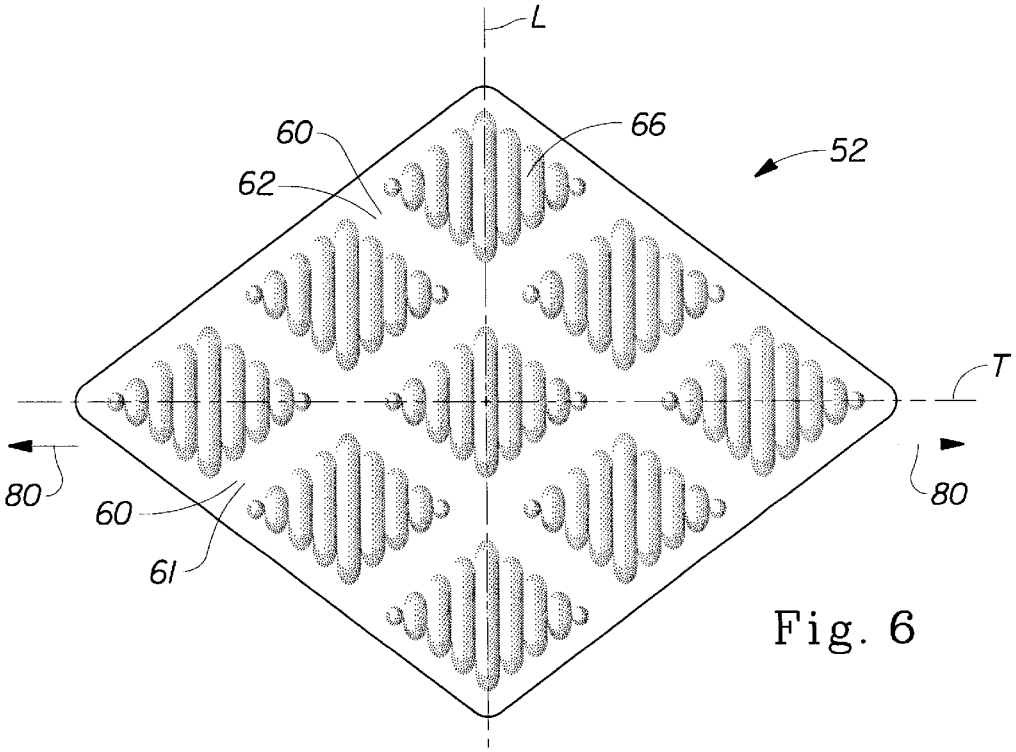
FIG. 6 is a plan view illustration of a polymeric web material of FIG. 5 in a partially-tensioned condition similar to the depiction of FIG. 4B.

Referring now to FIG. 6, as web 52 is subjected to an applied axial elongation, D, indicated by arrows 80 in FIG. 6, the first regions 60 having the shorter surface-pathlength, L1, provide most of the initial resistive force, P1, as a result of molecular-level deformation, to the applied elongation which corresponds to stage I. While in stage I, the rib-like elements 74 in the second regions 66 are experiencing geometric deformation, or unbending and offer minimal resistance to the applied elongation. In addition, the shape of the second regions 66 changes as a result of the movement of the reticulated structure formed by the intersecting first regions 61 and 62. Accordingly, as the web 52 is subjected to the applied elongation, the first regions 61 and 62 experience geometric deformation or bending, thereby changing the shape of the second regions 66. The second regions are extended or lengthened in a direction parallel to the direction of applied elongation, and collapse or shrink in a direction perpendicular to the direction of applied elongation.

In addition to the aforementioned elastic-like properties, a sheet material of the type depicted in FIGS. 5 and 6 is believed to provide a softer, more cloth-like texture and appearance, and is more quiet in use.

Various compositions suitable for constructing the flexible bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat, mechanical, or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. patents which are illustrative of the state of the art with regard to flexible storage bags similar in overall structure to those depicted in FIGS. 1 and 2 but of the types currently available are U.S. Pat. No. 5,554,093, issued Sep. 10, 1996 to Porchia et al., and U.S. Pat. No. 5,575,747, issued Nov. 19, 1996 to Dais et al.

Representative Closures:

Closures of any design and configuration suitable for the intended application may be utilized in constructing flexible bags according to the present invention. For example, drawstring-type closures, tieable handles or flaps, twist-tie or interlocking strip closures, adhesive-based closures, interlocking mechanical seals with or without slider-type closure mechanisms, removable ties or strips made of the bag composition, heat seals, or any other suitable closure may be employed. Such closures are well-known in the art as are methods of manufacturing and applying them to flexible bags.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible bag comprising at least one sheet of flexible sheet material assembled to form a semi-enclosed container having an opening defined by a periphery, said opening defining an opening plane, said bag being expandable in response to forces exerted by contents within said bag to provide an increase in volume of said bag such that said bag accommodates the contents placed therein, said sheet material including a first region and a second region being comprised of the same material composition, said first region undergoing a substantially molecular-level deformation and said second region initially undergoing a substantially geometric deformation when said sheet material subjected to an applied elongation along at least one axis.

2. The flexible bag of claim 1, wherein said bag is a product selected from the list consisting of trash bags, body bags, Christmas tree disposal bags, colostomy bags, dry cleaner bags, laundry bags, stock pick bags, and shopping bags.

3. The flexible bag of claim 1, wherein said bag includes a closure means for sealing said opening to convert said semi-enclosed container to a substantially closed container.

4. The flexible bag of claim 1, wherein said bag is formed from a planar sheet of material.

5. The flexible bag of claim 1, wherein a plurality of said bags are joined to one another to form a continuous web.

6. The flexible bag of claim 5, wherein said continuous web is wound about a cylindrical core to form a roll of bags.

7. The flexible bag of claim 5, wherein said continuous web is wound to form a coreless roll of bags.

8. The flexible bag of claim 1, wherein said first region and said second region are visually distinct from one another.

9. The flexible bag of claim 8, wherein said second region includes a plurality of raised rib-like elements.

10. The flexible bag of claim 9, wherein said first region is substantially free of said rib-like elements.

11. The flexible bag of claim 9, wherein said rib-like elements have a major axis and a minor axis.

12. The flexible bag of claim 1, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding the second regions.

13. The flexible bag of claim 1, wherein said sheet material exhibits at least two significantly different stages of resistive forces to an applied axial elongation along at least one axis when subjected to the applied elongation in a direction parallel to the axis in response to an externally-applied force upon the flexible storage bag when formed into a closed container;

wherein the first and second regions are visually distinct and comprise a strainable network;

the first region being configured so that it will exhibit a resistive force in response to the applied axial elongation in a direction parallel to the axis before a substantial portion of the second region develops a significant resistive force to the applied axial elongation;

the first region having a surface-pathlength which is greater than that of the second region, as measured parallel to the axis while the sheet materials is in an untensioned condition;

the first region exhibiting including one or more rib-like elements;

the sheet material exhibiting a first resistive force to the applied elongation until the elongation of the sheet material is great enough to cause a substantial portion of the first region to enter the plane of the applied axial elongation, whereupon the sheet material exhibits a second resistive force to further applied axial elongation; the sheet material exhibiting a total resistive force higher than the resistive force of the first region.

14. The flexible bag of claim 13, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

15. The flexible bag of claim 1, wherein said sheet material exhibits at least two-stages of resistive forces to an applied axial elongation, D, along at least one axis when subjected to the applied axial elongation along said axis in response to an externally-applied force upon said flexible storage bag when formed into a closed container;

the first and second region comprising: a strainable network of visually distinct regions;

the first region having a first surface-pathlength, L1, as measured parallel to the axis while the sheet material is in an untensioned condition;

the second region having a second surface-pathlength, L2, as measured parallel to the axis while the web material is in an untensioned condition;

the first surface-pathlength, L1, being less than the second surface-pathlength, L2; the first region producing by itself a resistive force, P1, in response to an applied axial elongation, D;

the second region producing by itself a resistive force, P2, in response to the applied axial elongation, D;

the resistive force P1 being substantially greater than the resistive force P2 when (L1+D) is less than L2.

16. The flexible bag of claim 15, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

17. The flexible bag of claim 1, wherein the sheet material exhibits an elastic-like behavior along at least one axis;

wherein the first and second regions each have an untensioned projected pathlength; and the first region and said second region substantially return to their untensioned projected pathlength when said applied elongation is released.

18. The flexible bag of claim 17, wherein said sheet material includes a plurality of first regions and a plurality of second regions comprised of the same material composition, a portion of said first regions extending in a first direction while the remainder of said first regions extend in a direction perpendicular to said first direction to intersect one another, said first regions forming a boundary completely surrounding said second regions.

* * * * *